US005181284A

United States Patent [19]

Raphael et al.

[11] Patent Number: 5,181,284

[45] Date of Patent: Jan. 26, 1993

[54] INFANT BATHTUB

[76] Inventors: Jacques E. Raphael; Deirdre R. Raphael, both of 8251 Sanberry Blvd., Orlando, Fla. 32819

[21] Appl. No.: 158,551

[22] Filed: Feb. 22, 1988

[51] Int. Cl.[5] ..... A47K 3/024

[52] U.S. Cl. ..... 4/572.1; 4/573.1

[58] Field of Search ..... 4/572, 573, 575, 578, 4/586, 589, 590, 594, 567, 568, 570, 515, 516, 517, 518, 654, 619

[56] References Cited

U.S. PATENT DOCUMENTS

| | | | |
|---|---|---|---|
| 1,512,068 | 10/1925 | Thornburg | 4/572 |
| 1,856,992 | 5/1932 | Gaddess | 4/594 |
| 2,461,260 | 2/1949 | Du Puy et al. | 4/586 X |
| 2,518,604 | 8/1950 | Douglas | 4/586 X |
| 2,569,247 | 9/1951 | Mazzola et al. | 4/657 |
| 3,078,474 | 2/1963 | Chaitlen | 4/575 |
| 3,248,741 | 5/1966 | Stout et al. | 4/567 |
| 3,995,331 | 12/1976 | Fotre et al. | 4/572 |
| 4,037,591 | 7/1977 | Sarno | 4/573 X |
| 4,561,135 | 12/1985 | Adriaansen | 4/572 |
| 4,860,391 | 8/1989 | Hildebrandt | 4/518 |

FOREIGN PATENT DOCUMENTS

| | | | |
|---|---|---|---|
| 1457399 | 4/1969 | Fed. Rep. of Germany | 4/518 |
| 1260152 | 3/1961 | France | 4/559 |
| 2589 | 2/1886 | United Kingdom | 4/594 |
| 485693 | 5/1938 | United Kingdom | 4/638 |
| 848474 | 9/1960 | United Kingdom | 4/572 |
| 2053673 | 2/1981 | United Kingdom | 4/575 |

*Primary Examiner*—Charles E. Phillips
*Attorney, Agent, or Firm*—William M. Hobby, III

[57] ABSTRACT

An infant bathtub apparatus is provided having an tub housing having an inside including an inside bottom and a plurality of housing walls for holding bath water therein. The tub housing has two slanted walls and a flange around the periphery of the housing. A plurality of legs are removably attached to the tub housing for supporting the tub thereon while a plurality of article containers are formed in the tub housing flange around the periphery of the housing. A removable support surface is removably located in the tub housing and has an arcuate surface on one end thereof for support on said flange around the periphery of the housing. The removable support has hook and loop material located beneath the other end portion thereof for removably attaching the support surface to the bottom of the tub housing so that an infant bathtub can support a baby therein.

5 Claims, 1 Drawing Sheet

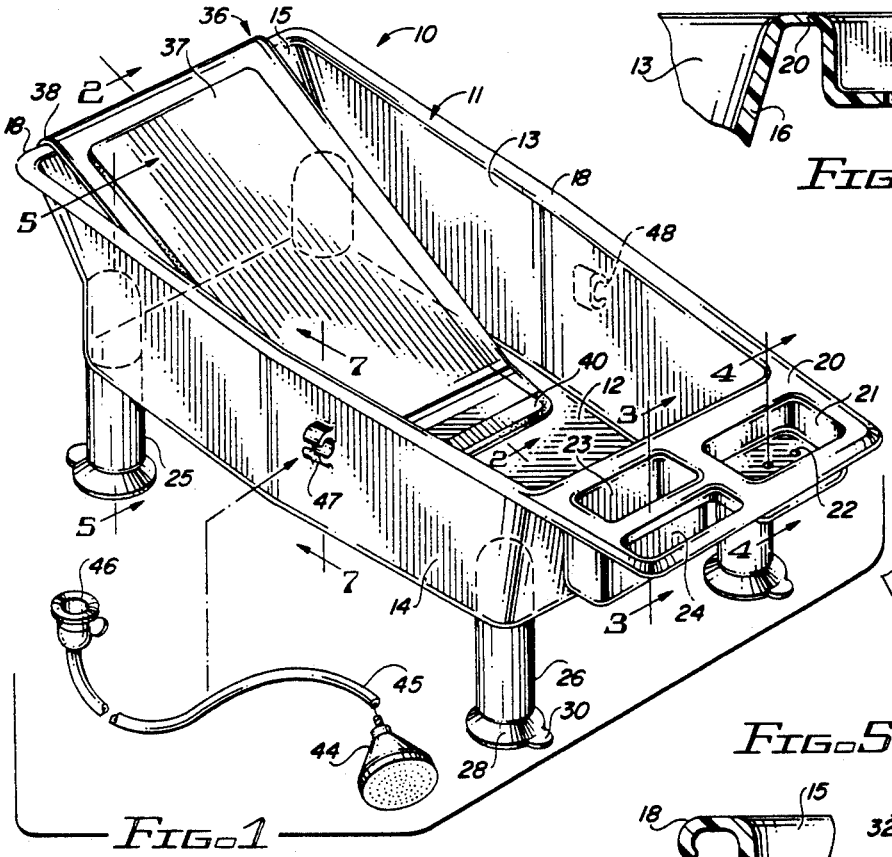
FIG. 1
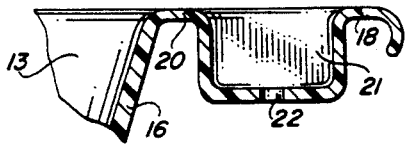
FIG. 4
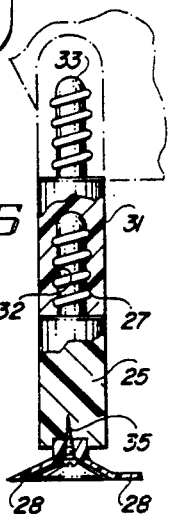
FIG. 5
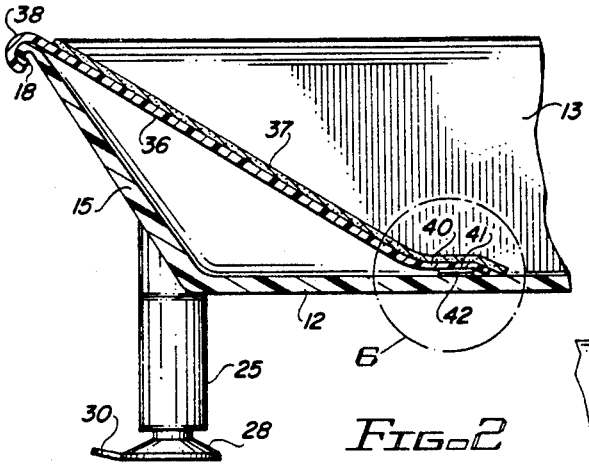
FIG. 2
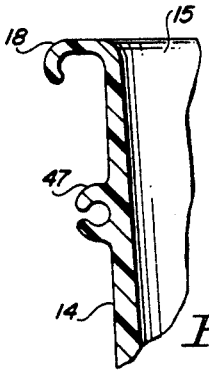
FIG. 7
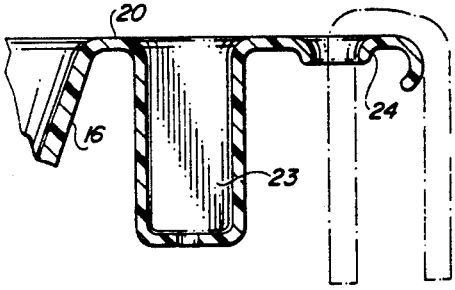
FIG. 3
FIG. 6
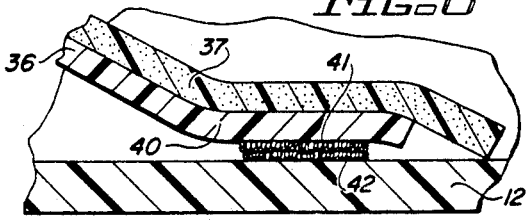

INFANT BATHTUB

BACKGROUND OF THE INVENTION

The present invention relates to infant bathtubs and especially to an infant bathtub having a variety of adjustments for supporting an infant therein.

In the past, a wide variety of infant bathtubs have been provided and typically these have an inside with a bottom and a plurality of sides. The tubs today are made of a polymer material for holding water for washing small babies. The tubs are sometimes propped up and are sometimes formed with a table. The present invention is directed towards an infant's tub which has the flexibility to provide a variety of adjustments in height and support for articles used for washing the baby and which can be inexpensively manufactured and sold.

Prior U.S. patents which show bathtubs include Sutton U.S. Pat. No. 4,574,406, which shows a tub comforter for placing in a conventional bathtub while the prior Knight U.S. Pat. No. 766,702, is for a tub having removable legs. The Tymcznya U.S. Pat. No. 1,293,253, shows an adjustable laboratory while the Du Bois child shampoo chair, U.S. Pat. No. 2,697,480, has an adjustable back. The Lafield Pat. No. 2,461,744, has a pair of adjustable legs.

The aim of the present invention is to provide a fully adjustable infant bath which can have a variety of adjustments for height and to provide a resilient supporting surface which can be removed from the tub while having a variety of article containers formed in the polymer housing and a support for a spray head to ease the task of bathing an infant while providing the infant greater comfort.

SUMMARY OF THE INVENTION

The present invention relates to an infant's bathtub which has a tub housing having an inside including an inside bottom and a plurality of housing walls for holding bath water therein. The tub housing has two slanted walls and a flange thereon. A plurality of legs are removably attached to the tub housing for supporting the tub housing therein. A plurality of article containers are formed in the tub housing flange around the periphery of the walls of the tub. The tub has a removable support surface removably attached inside the tub housing and has an arcuate surface on one end thereof for supporting the support surface on the housing flange. A removable support surface has attaching means located beneath the other end portion of the support surface for removably attaching the support surface to the bottom of the tub. The attaching means can be hook and loop material having a strip placed on the bottom of the infant's tub and a strip placed on the bottom of the support surface. The support surface can be flattened out to fit on the bottom of the tub. A spray hose support is formed into each side of the tub housing for supporting a spray head nozzle. Each of the legs may have a suction cup for holding the tub in place while the legs may be threadedly attached to the bottom of the housing and may have extension sections threadedly attached into each other for raising either ends or both ends of the tub. A drain is formed into the tub and an open slot is formed into the flange for holding a rag. The support surface in the tub may have a resilient material for cushioning the infant and preventing his sliding while the infant is positioned thereon.

BRIEF DESCRIPTION OF THE DRAWINGS

Other objects, features, and advantages of the present invention will be apparent from the written description and the drawings in which:

FIG. 1 is a perspective view of an infant tub in accordance with the present invention with the spray head and spray head hose exploded therefrom;

FIG. 2 is a sectional view taken on the line 2—2 of FIG. 1;

FIG. 3 is a sectional view taken on the line 3—3 of FIG. 1;

FIG. 4 is a sectional view taken on the line 4—4 of FIG. 1;

FIG. 5 is a sectional view taken on the line 5—5 of FIG. 1;

FIG. 6 is a sectional view taken on the circle 6 of FIG. 2; and

FIG. 7 is a sectional view taken on the line 7—7 of FIG. 1.

DESCRIPTION OF THE PREFERRED EMBODIMENT

Referring to the drawings of FIGS. 1 through 7, an infant's tub 10 is illustrated in FIG. 1 having a tub housing 11 having a bottom 12, a pair of elongated sides 13 and 14, one slanted end 15, a second end wall 16 forming the interior of the tub for holding bath water. The tub walls 13, 14, 15 and 16 have a periphery flange 18 therearound which flanges are arcuate but has an extended end portion 20 on one end thereof having a soap container 21 having a plurality of openings 22 in the bottom thereof and an article container 23 formed on the surface 20. A slot 24 is formed with an opening through the surface 20 for hanging a rag as illustrated in FIG. 3. Thus, the end of the tub 10 may support a rag or towel, soap, scrub brushes, toys, and the like, for ready excess during bath time for the infant. The tub housing 11 has a pair of front legs 25 and a pair of rear legs 26, each leg having a threaded end 27 as shown in FIG. 5 and each having a suction cup 28 on the end thereof having a lifting tab 30.

The legs are threaded onto the tub body 11 as shown in FIG. 1 and may have an extension member 31 as shown in FIG. 5. Extension member 31 has internal threads 32 for supporting the external threads 27 of the leg 25 and has a threaded portion 33 for threading into the tub. Any number of extensions can be used as desired to raise one or both ends of the tub. Each suction cup 28 on the bottom of the tub has a threaded screw 35 therein which is threaded into the bottom of the leg 25 (or tub) as seen in FIG. 5.

An infant support surface 36 has a resilient surface such as a foamed polymer surface 37 formed thereon for supporting a baby thereon in a comfortable non-slip manner. One end of the support surface 36 has an arcuate edge 38 for slipping over the arcuate flange 18 in a mating fashion for supporting one end thereof and has a bent or flattened surface 40 on the other end thereof having hook and loop material 41 attached to the bottom thereof as shown in FIG. 2. An inclined surface extends between the flattened surface and the arcuate flange. A strip of hook and loop material 42 is attached at the appropriate position on the bottom 12 of the tub housing 11 for attaching the strip of VELCRO 41 thereto for supporting the other end of the support surface 36. The support surface is firmly locked into the tub but allows a quick removal by pulling up the end 40 to release the VELCRO portions so that the arcuate end 38 can be pulled off of the arcuate flange 18. The tub 10 is used in connection with a water spray head 44 connected to a water hose 45 and to a faucet coupling 46. The faucet coupling can be coupled to a faucet and the hose spray head can be attached to a snap attachment 47 formed on the wall 14 or a snap attachment 48 attached onto the wall 13 on the outside thereof. This provides a place to support the spray head 44 when not in use and to allow ready access when ready to spray the infant being washed.

It should be clear at this point that an infant's tub has been provided which provides for a variety of adjustments to make the washing of an infant more convenient and which may also be readily cleaned after the baby has been washed to maintain the tub when the tub is not used. The adjustments allow different persons to work with the baby and to provide better support for the baby. The present invention, however, is not to be considered as limited to the forms shown which are to be considered illustrative rather than restrictive.

I claim:

1. A infant bathtub comprising:

a tub housing having an inside including a bottom and a plurality of walls upstanding from said bottom for holding bath water therein, said upstanding walls having an outwardly directed arcuate flange around their periphery, said tub housing having a spray hose snap attachment connected on an exterior thereof;

a plurality of legs removably attached to said tub housing for supporting said tub housing thereon, each of said plurality of legs having a suction cup mounted on the bottom thereof;

a plurality of article containers and at least one slot formed in said tub housing flange, and a support surface removably located in said tub housing and having an arcuate surface on one end thereof for slipping over said arcuate flange in a mating fashion, an inclined surface extending from said arcuate surface to a flattened surface angled from said inclined surface for laying flat on the tub housing bottom a removable support surface attaching means having one of a hook and loop material placed on the bottom of the flattened end portion and another of a hook and loop material placed on the bottom surface of the tub said removable support surface also having a resilient foamed polymer material formed on the top thereof for supporting an infant thereon in a non-slip manner, whereby with said arcuate surface engaged over said arcuate flange said hook and loop material will cooperate to hold said support surface firmly locked onto said tub.

2. An infant bathtub in accordance with claim 1 in which said spray hose support means includes a snap connector for spray head hose on two sides of said elongated tube housing.

3. An infant bathtub in accordance with claim 2 in which each said suction cup has a lifting tab thereon.

4. An infant bathtub in accordance with claim 3 in which each leg section has an external threaded extension formed thereon for threading into an internal threaded portion formed in said elongated tub housing bottom.

5. An infant bathtub in accordance with claim 4 in which a plurality of leg extensions have interior threaded portions for receiving one of said plurality of legs exterior threaded portion therein and an exterior threaded portion for threading into the bottom of said elongated tub housing.

* * * * *